US011064810B2

(12) United States Patent
Snir et al.

(10) Patent No.: US 11,064,810 B2
(45) Date of Patent: Jul. 20, 2021

(54) CHAIR HAVING REMOVABLE CUP HOLDER

(71) Applicant: Adams Mfg. Corp., Portersville, PA (US)

(72) Inventors: Shlomo Snir, Greensboro, NC (US); Robert G. Schreiber, Prospect, PA (US)

(73) Assignee: Adams Mfg. Corp., Portersville, PA (US)

( * ) Notice: Subject to any disclaimer, the term of this patent is extended or adjusted under 35 U.S.C. 154(b) by 0 days.

(21) Appl. No.: 16/913,291

(22) Filed: Jun. 26, 2020

(65) Prior Publication Data

US 2021/0007495 A1 Jan. 14, 2021

Related U.S. Application Data

(63) Continuation-in-part of application No. 29/674,465, filed on Dec. 21, 2018, now Pat. No. Des. 892,566, and a continuation-in-part of application No. 29/674,470, filed on Dec. 21, 2018, now Pat. No. Des. 892,567.

(51) Int. Cl.
*A47C 7/62* (2006.01)

(52) U.S. Cl.
CPC ..... *A47C 7/624* (2018.08)

(58) Field of Classification Search
CPC ..... A47C 7/624; A47C 7/622; B60N 3/10; A47G 23/0216; A47G 23/02
USPC ..... 297/188.18, 188.14, 188.15; 248/309.1, 248/311.2, 311.3
See application file for complete search history.

(56) References Cited

U.S. PATENT DOCUMENTS

| | | | | |
|---|---|---|---|---|
| 3,215,467 | A | 11/1965 | McFarland et al. | |
| 3,233,940 | A * | 2/1966 | Tooley, Jr. | A47C 7/62 297/188.18 |
| D257,113 | S | 9/1980 | McCaffrey | |
| D304,795 | S | 11/1989 | Klopp | |
| 5,295,650 | A * | 3/1994 | Brandt | A47C 7/68 248/311.2 |
| D361,924 | S | 9/1995 | Becker | |
| 5,533,782 | A * | 7/1996 | Goldman | A47C 7/62 297/188.18 |
| 5,797,655 | A | 8/1998 | Miles | |
| D398,127 | S | 9/1998 | Bergin et al. | |
| D400,678 | S | 11/1998 | Clark et al. | |
| 5,865,412 | A * | 2/1999 | Mason | A47C 7/624 248/311.2 |
| 5,865,413 | A | 2/1999 | Mason | |
| D412,769 | S | 9/1999 | Mason | |
| 6,010,104 | A | 1/2000 | Hanson et al. | |

(Continued)

*Primary Examiner* — Mark R Wendell
(74) *Attorney, Agent, or Firm* — Buchanan Ingersoll & Rooney PC

(57) ABSTRACT

A stackable molded plastic chair has a removable cup holder that may be placed on the top surface of a chair arm for use or attached to the underside of the chair arm for storage. The cup holder has an inverted U-shaped body that fits over a chair arm and a cup receiver that is connected to that body. There is a post that extends from the bottom surface of the chair arm and is sized and configured to fit through the hole in the cup receiver and create a snap-fit. The cup holder may also have a cell phone pocket at either side of the inverted U-shaped body.

20 Claims, 6 Drawing Sheets

(56) References Cited

U.S. PATENT DOCUMENTS

| | | | | |
|---|---|---|---|---|
| 6,361,105 | B1 * | 3/2002 | Turner | A47C 7/62<br>297/16.2 |
| 6,478,371 | B1 | 11/2002 | Clarke | |
| D516,393 | S | 3/2006 | Wickenhauser | |
| D534,397 | S | 1/2007 | Burch | |
| 7,249,799 | B2 | 7/2007 | Luce | |
| 8,333,429 | B2 | 12/2012 | Nelson et al. | |
| D673,816 | S | 1/2013 | Phillips | |
| 8,636,319 | B1 | 1/2014 | Parker, Jr. | |
| 9,532,654 | B1 | 1/2017 | Adams, IV et al. | |
| D787,848 | S | 5/2017 | Adams, IV et al. | |
| 2005/0051690 | A1 | 3/2005 | Phillips et al. | |
| 2012/0007394 | A1 | 1/2012 | Nelson et al. | |
| 2019/0357688 | A1 * | 11/2019 | Dobson | F16M 13/022 |

* cited by examiner

CHAIR HAVING REMOVABLE CUP HOLDER

FIELD OF INVENTION

The invention relates to chairs having a cup holder on one or both arms of the chair.

BACKGROUND OF THE INVENTION

There are many types of chairs which have cup holders on one or both arms of the chair. One type of cup holder consists of a circular opening in the top surface of the arm of the chair which is sized to receive a cup or other beverage container. The opening may be tapered to hold the cup with a friction fit or there may be a cupped shaped structure below the opening which holds the cup or beverage container. Significant disadvantages of this type of cup holder are that the opening in the chair arm detracts from the appearance of the chair, resting one's arm on a chair arm having an opening can be uncomfortable, and objects can fall through or become stuck in the opening.

Another type of cup holder is mounted on and extends outward from the chair arm. Some such cup holders are attached to the arm by straps, clamps or clips and are removable from the chair arm when not in use. Examples of this type of cup holder can be found in U.S. Pat. No. 8,636,319 B1 and Published United States Patent Application No. 2006/0061155 A1. While removable cup holders do not detract from the appearance of the chair arm, they can become loose. If this type of cup holder is stored separate from the chair, the cup holder can easily be misplaced or lost. Of course, this problem can be overcome by permanently attaching the cup holder to the chair arm. But permanently attached cup holders can interfere with people walking by the chair, prevent similar chairs from being placed close together side by side, and can prevent stacking, or cause uneven stacking, of chairs.

Yet, another type of cup holder is attached to the underside of a chair arm or to the arm support and can pivot between a closed position in which the cup holder is nested under the arm of the chair for storage and an extended position for use. U.S. Pat. Nos. 6,361,105 B1, 8,182,031 B2 and 9,532,654 B1 disclose this type of cup holder. While this type of cup holder does not have many of the problems of the other cup holders described above, they too can become loose and not stay in a nested position or extended position. Furthermore, this type of cup holder can bend or break when a person sitting in the chair uses the extended cup holder, rather than the arm of the chair, for support when getting out of the chair. This type of cup holder may also prevent or impede stacking of the chair.

The industry has failed to develop a chair having a cup holder that can be held under a chair arm for storage and shipment and can be removed by the user and clipped onto the chair for use. Preferably the cup holder and will be locked onto the chair arm in either the storage position or on the chair arm after being placed in that position by the user. The cup holder should be capable of holding a cup, tumbler, wine glass and any one of all commonly used types of beverage bottles from which people routinely drink. Preferably the cup holder should also have a pocket that will hold other objects such as keys or a cell phone.

Preferably the cup holder is made of that same or similar plastic as the chair to which it is attached.

SUMMARY OF THE INVENTION

A chair is provided having a seat and a seat back attached to the rear edge of the seat, legs extending from the seat and a pair of arms. The chair has a cup holder having an inverted U-shaped body with a flat portion or base and an upright extending from each end of the base. A cup receiver is attached to a first upright. A pocket sized to hold a cell phone or other objects can be attached to the second upright or placed between the cup receiver and the first upright. The inverted U-shaped body is sized to fit over and clip onto the arm of the chair, such that the base of the body rests on the top surface of the chair arm and the chair arm is between the uprights of the body that extend from opposite ends of the base. A hook is preferably provided on each upright that engages the chair arm when the cup holder is placed on the chair arm.

The bottom surface of the chair arm has a post that fits through a hole in the bottom of a cup receiver. An enlarged head is provided at the end of the post and the head is sized to create a snap fit of the cup receiver onto the post. The head and the hole in the bottom of the cup receiver are sized and configured so that the cup holder may be repeatedly attached to and removed from the underside of chair arm. There may also be a hook or hooks on the underside of the arm that engage the base of the cup holder while the cup holder is in the storage position.

The chair preferably is a stackable molded plastic chair and the cup holder is also made of plastic.

Other objects and advantages of the present invention will become apparent from a description of certain presently preferred embodiments shown in the figures.

DETAILED DESCRIPTION OF THE PREFERRED EMBODIMENTS

Figure 1:
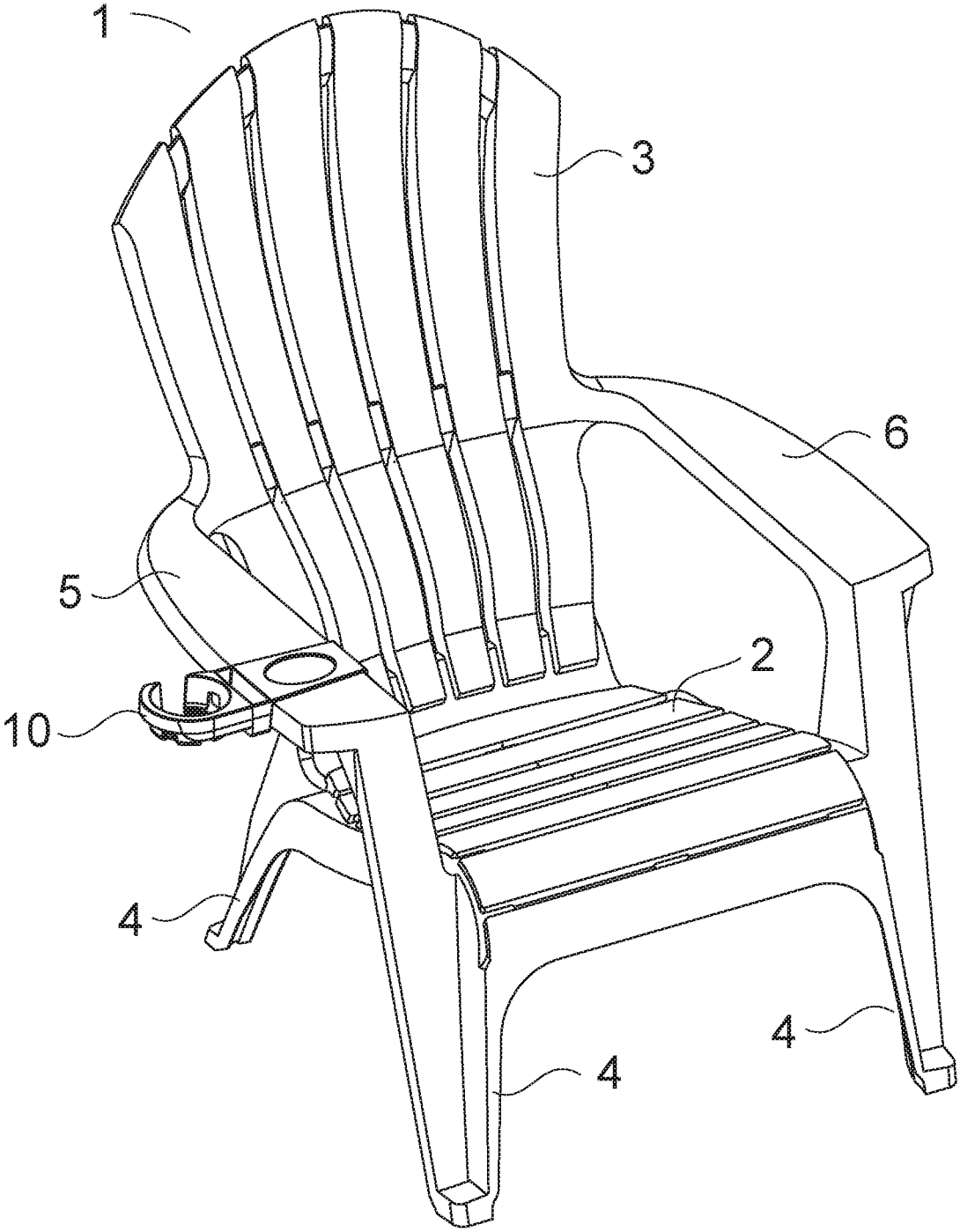
FIG. 1 is a front perspective view of a present preferred embodiment of our chair having a one embodiment of our removable cup holder with the cup holder on the top surface of one arm of the chair.
Figure 2:
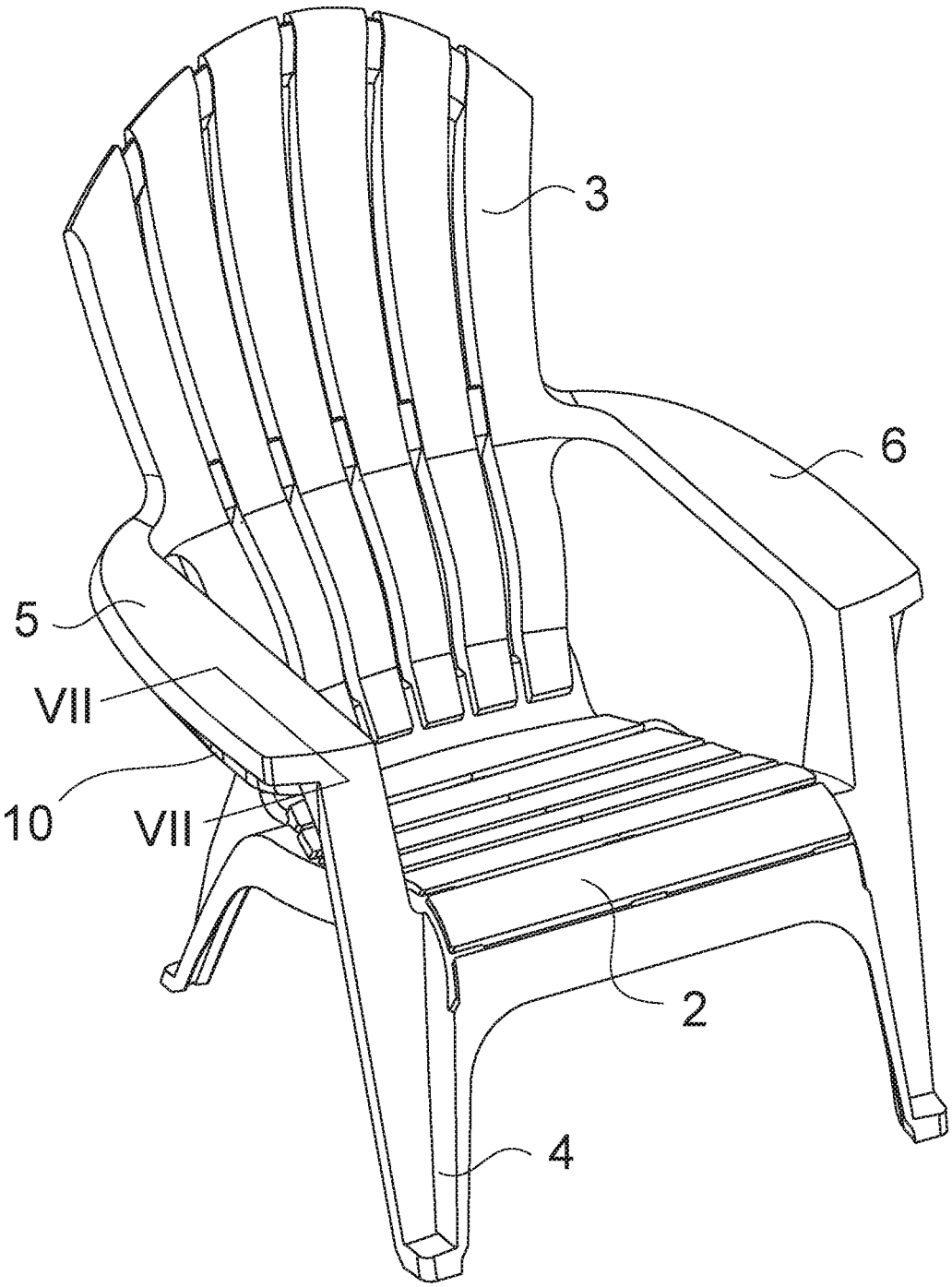
FIG. 2 is front perspective view similar to FIG. 1 with the cup holder being held underneath the chair arm in a storage position.
Figure 3:
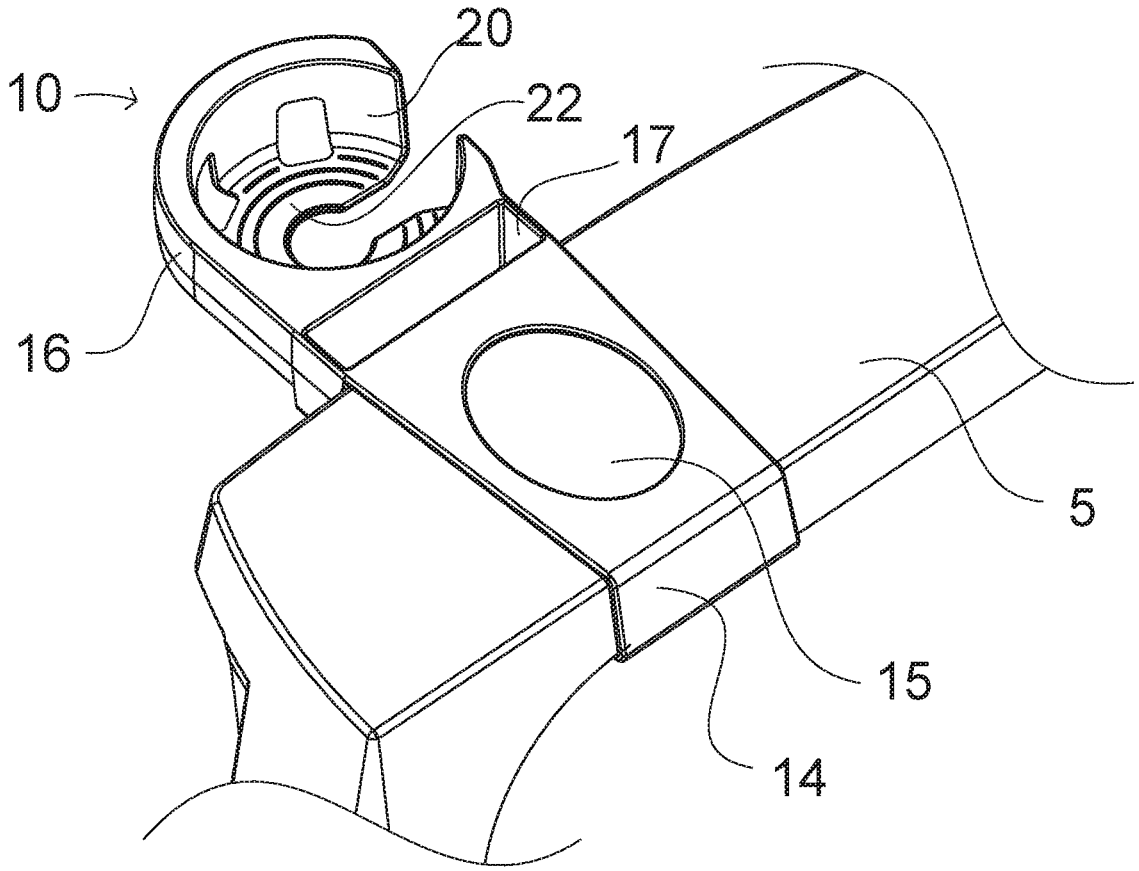
FIG. 3 is a perspective view of the cup holder as shown in FIG. 1 on a portion of the chair arm.
Figure 4:
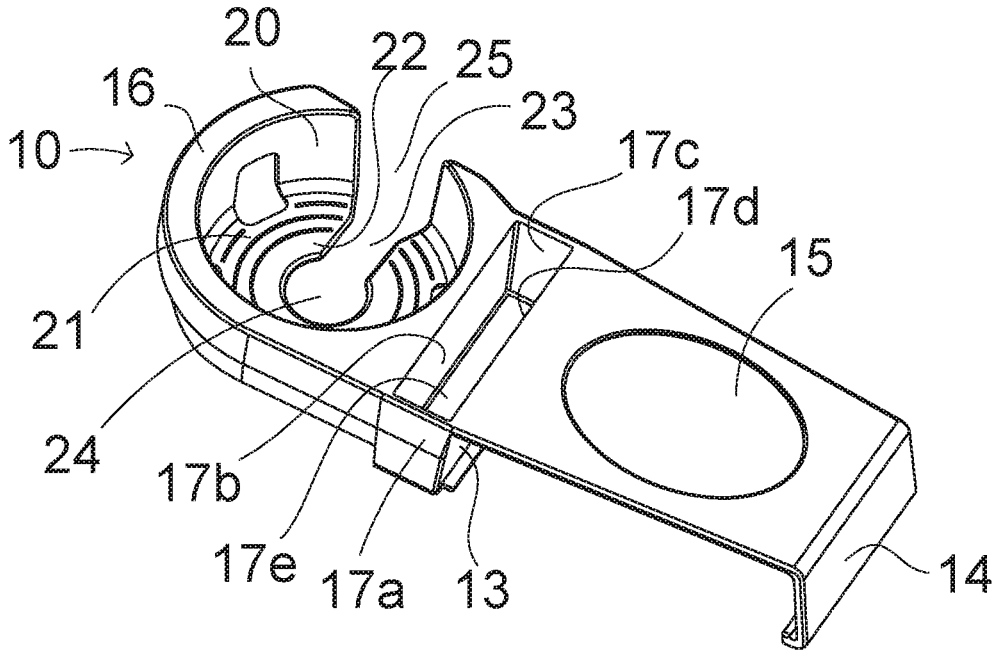
FIG. 4 is a top perspective view of the cup holder shown in FIGS. 1 and 3.
Figure 5:
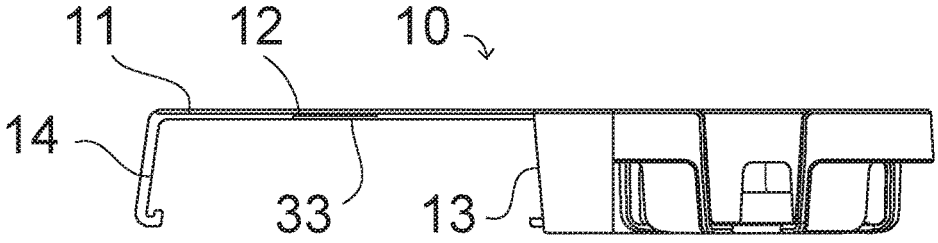
FIG. 5 is a side view of a portion of the cup holder shown in FIG. 4.

As can be seen in FIGS. 1 and 2 we provide a chair 1 having a seat 2, back 3, legs 4, right arm 5 and left arm 6. In the chair shown in the drawings the arms 5, 6 are attached to both the seat 2 and the back 3. However, the arms could be attached to only the seat or could be attached only to the back. We further provide a cup holder 10 which is attached to one of the arms. In the drawings the chair 1 has one cup holder 10 attached to the right arm 5. However, the chair may have one cup holder attached to the left arm or two cup holders, one attached to each arm. FIG. 1 shows a first present preferred embodiment of our cup holder 10 placed on top of the chair arm 5 for use. FIG. 2 shows that cup holder 10 attached to the underside of the chair arm 5 in a storage position.

Figure 8:
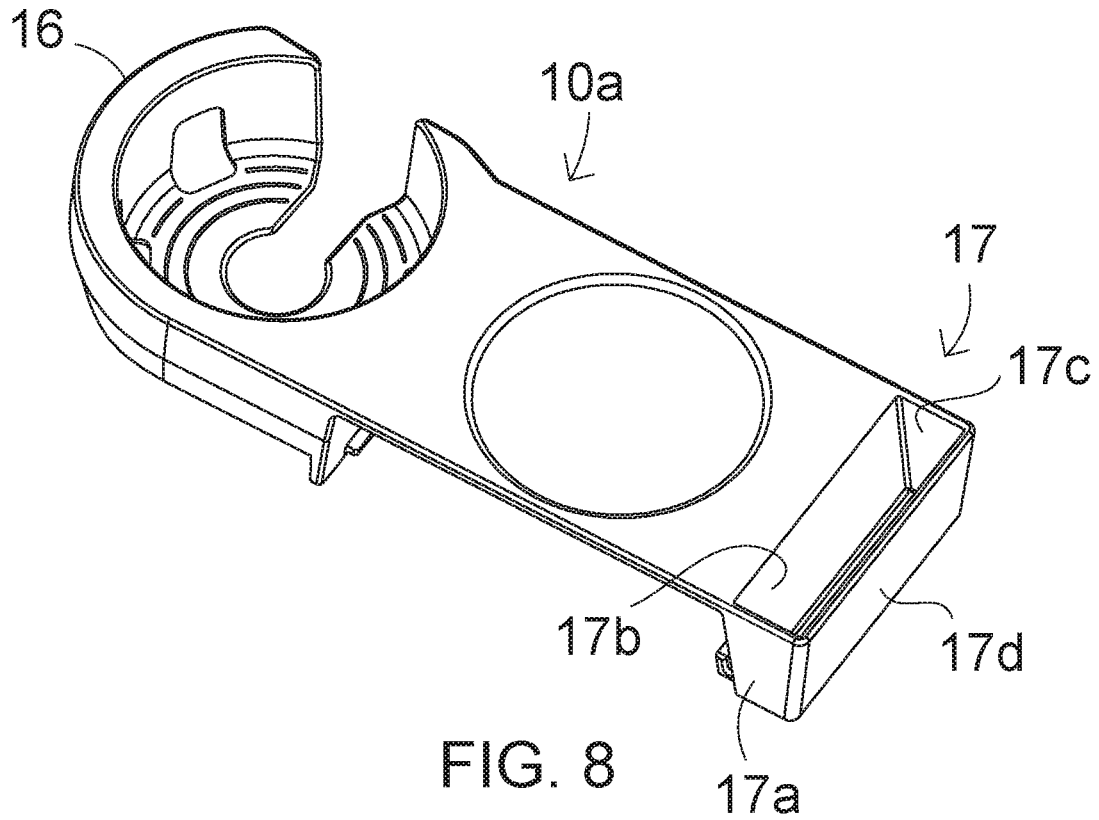
FIG. 8 is a perspective view of a second present preferred cup holder.
Figure 9:
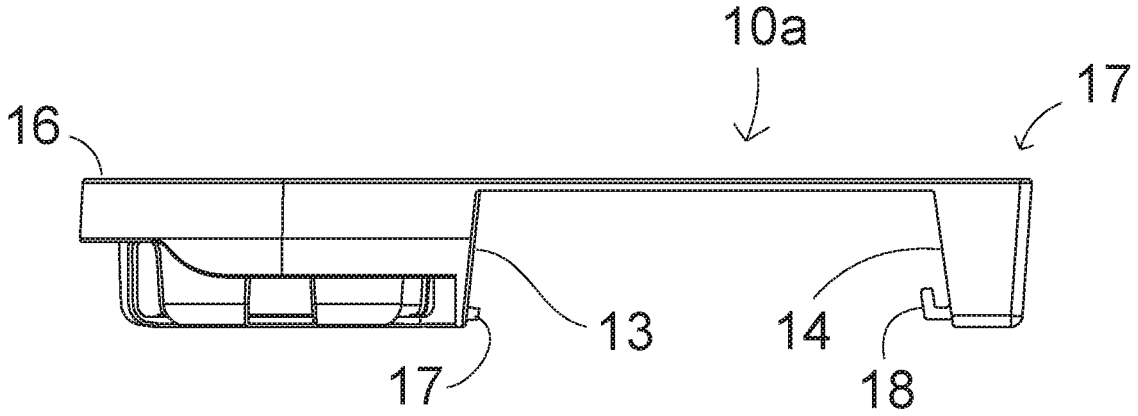
FIG. 9 is a side view of the cup holder shown in FIG. 8.
Figure 10:
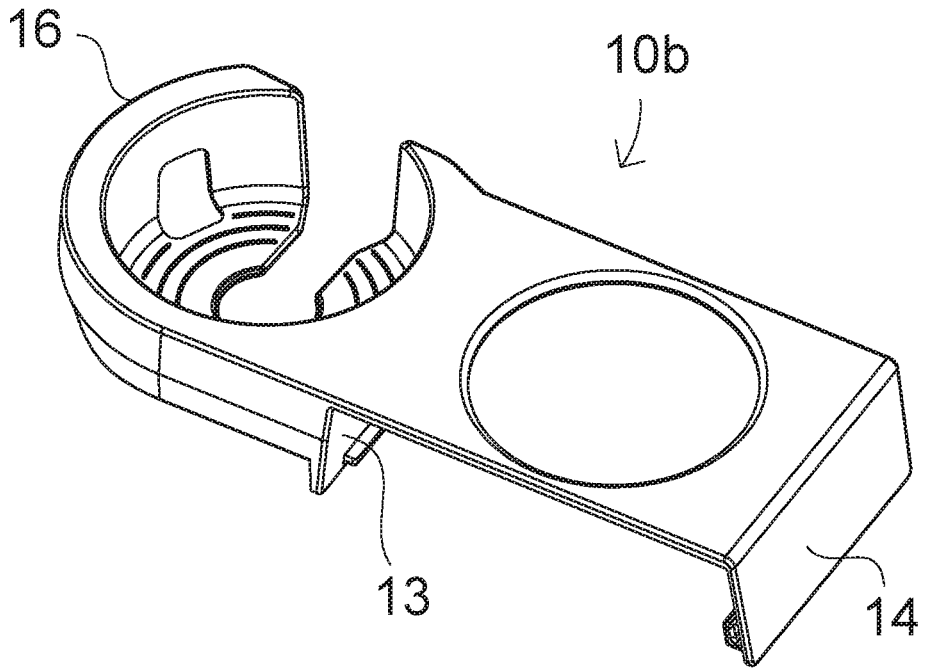
FIG. 10 is a perspective view of a third present preferred cup holder.
Figure 11:
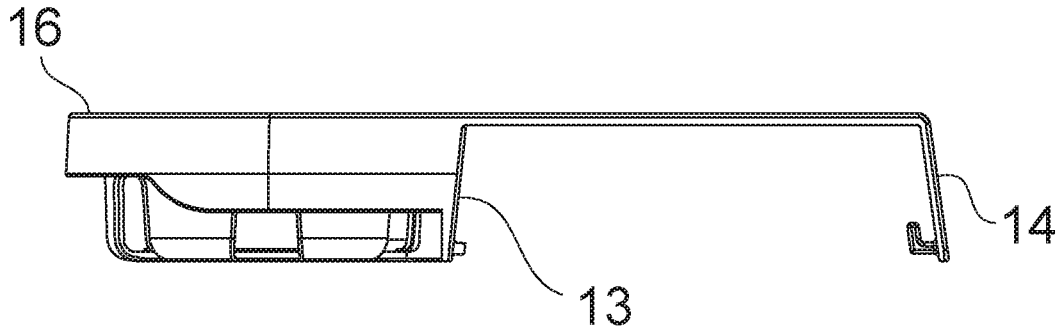
FIG. 11 is a side view of the cup holder shown in FIG. 10.

Referring to FIGS. 1, 3, 4 and 5, the cup holder 10 has an inverted U-shaped body 11 with base 12 and a pair of uprights 13 and 14 extending from the base. There may be an opening 15 in the base to reduce the amount of material in the base. That opening could be sized to receive an insert (not shown) that is decorative or carries a logo, advertising or other information. A cup receiver 16 is attached to a cell phone pocket 17. The cell phone pocket consists of four sidewalls 17*a*, 17*b*, 17*c* and 17*d* that extend from base 17*e*. In this embodiment one wall 17*d* of the pocket 17 is the first upright 13. In another embodiment 10*a* shown in FIGS. 8 and 9 the pocket 17 is attached to upright 14. That upright is wall 17*b* of the pocket. In yet another embodiment 10*b* shown in FIGS. 10 and 11 there is no pocket and the cup receiver 16 is attached directly to the first upright 13. The pocket 17 is sized to hold a cell phone, but could be sized to hold other objects, such as keys, in addition to a cell phone. The inverted U-shaped body 11 is sized to fit over and clip onto the arm of the chair, such that the base 12 of the body rests on the top surface of the chair arm and the chair arm is between the uprights 13, 14 of the body 11 that extend from opposite ends of the base. A tab 17 or hook 18 is preferably provided on each upright 13, 14 that engages the chair arm 5 when the cup holder 10, 10*a* 10*b* is placed on the chair arm 5.

The cup receiver 16 has a generally cylindrical wall 20 that surrounds the opening 21 and extends to a base 22 on which a cup being held (not shown) can rest. We prefer to provide an opening 25 in the side wall 20 and a slot 23 in the base that extends from the opening 25 in the side wall 20 to a hole 24 in the center of the base 22 that enable the cup holder to securely hold a wine glass. The wine glass can be placed in the cup holder so that the stem of the glass extends through the hole 24.

The cup holder shown in the drawings will hold from 5 to 10 pounds depending upon the material from which the cup holder is made. To remove the cup holder 10 from the arm 5 the user pulls the bottom edge of the inner upright 14 toward the other arm 6 of the chair, causing the upright to flex and release hook 18 from the arm. Then the cup holder can be removed from the chair arm.

Figure 6:
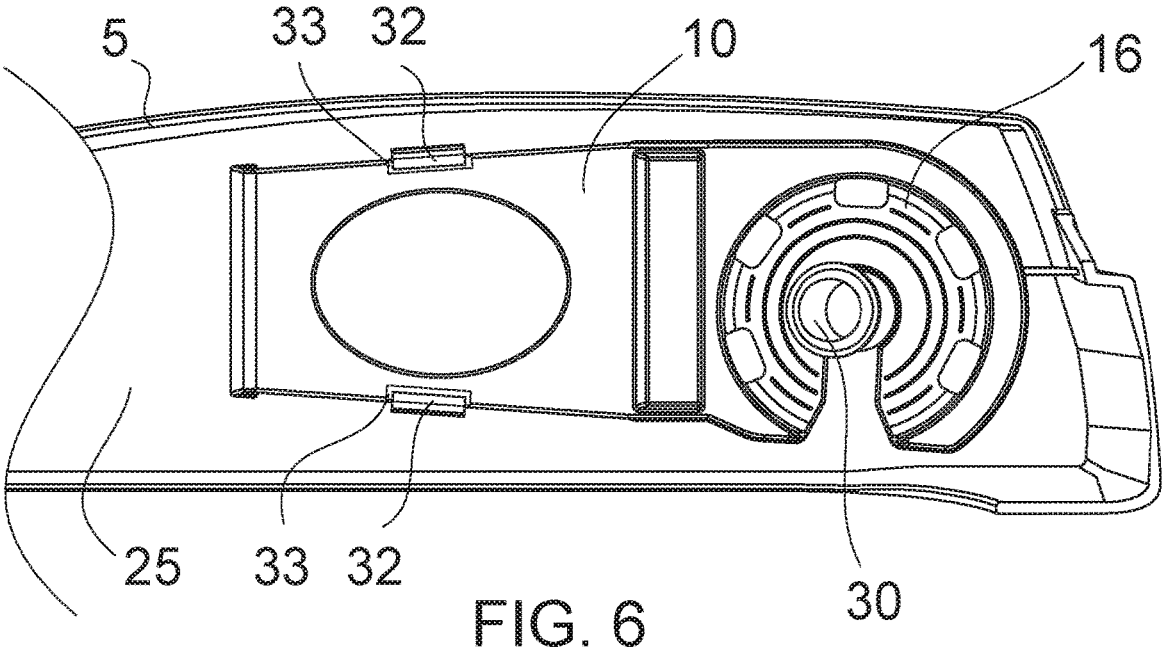
FIG. 6 is a plan view of the underside of a portion the chair arm with cup holder attached in the storage position shown in FIG. 2.
Figure 7:
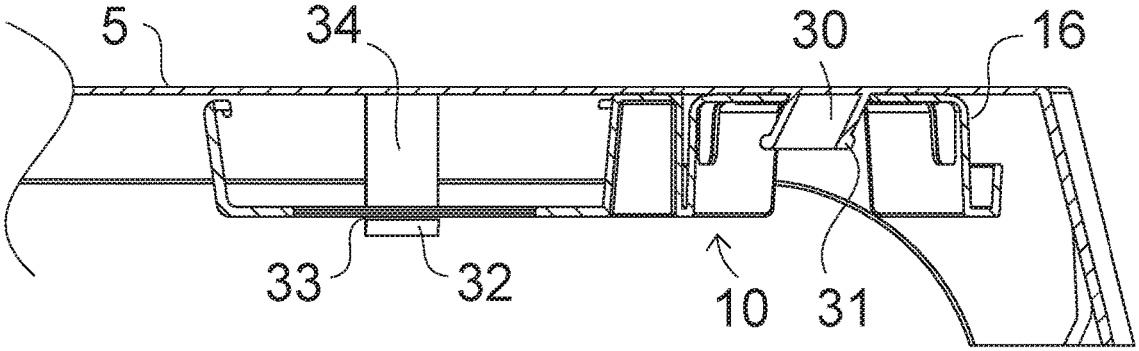
FIG. 7 is a sectional view taken along the line VII-VII n FIG. 2.

Once removed from the chair arm the cup holder can be connected to the underside of the chair arm for storage as shown in FIGS. 2, 6 and 7. The bottom surface 25 of the chair arm 5 has a post 30 that fits through the hole 24 in the bottom of the cup receiver 16. An enlarged head 31 is provided at the end of the post 30. The head 31 is sized to create a snap fit of the cup holder 10 onto the post. The head 31 and the hole 24 in the bottom of the cup receiver 16 are sized and configured so that the cup holder 10 may be repeatedly attached to and removed from the underside of chair arm 5. There may also be a hook or hooks 32 on the underside of the chair arm 5 that engage a detent 33 in the base 11 of the cup holder 10 while the cup holder is in the storage position.

As an alternative the opening 15 in the base of the inverted U-shaped body could be smaller and a post 34, shown in broken line in FIG. 7 could be provided in place of or addition to post 30. Post 34 could be sized and configured to fit through that smaller hole and create a snap fit of the cup holder onto the post 34.

The chair and the cup holder are preferably an injected molded plastic product. The plastic may be polypropylene, polyvinylchloride polycarbonate, ABS or other suitable plastic. If desired, the plastic may also be reinforced with fiberglass or filled with other materials commonly used in the industry. The pin can be made of a harder plastic than the plastic used to make the chair and the cup holder. If the pin is a harder material than the chair, then the feet can be configured to embed into the inner wall of the boss that extends from the underside of the chair arm. Lexan and polycarbonate are suitable plastics for the pin. In a preferred embodiment of our chair, the cup holder and the chair are made from polypropylene and the pin is polycarbonate.

Although we have shown and described certain present preferred embodiments of our chair having a retractable cup holder our invention is not limited thereto but may be variously embodied within the scope of the following claims.

We claim:

1. A chair with removable cup holder comprising:

a chair having a pair of arms each arm having a top surface, a bottom surface opposite the top surface and a post on the bottom surface of a selected one of the pair of chair arms; and a cup holder comprising:

a U-shaped body having a base having a first end, a second end opposite the first end, a first upright attached to the first end and a second upright attached to the second end, the first upright being spaced from the second upright such that the U-shaped body will fit onto the selected one of the pair of chair arms, such that the base is resting on the top surface of the selected one of the chair arms and the selected one of the pair of chair arms being between the uprights;

a cup receiver having a bottom with a hole through the bottom and at least one sidewall extending from the bottom, the cup receiver attached to the first upright;

wherein the post on the bottom surface of the selected one of the pair of chair arms is sized and configured to fit through the hole in the cup receiver and create a snap-fit.

2. The chair with removable cup holder of claim 1 also comprising a cell phone holder attached to the second upright.

3. The chair with removable cup holder of claim 2 wherein the cell phone holder and the second upright are molded as a single structure.

4. The chair with removable cup holder of claim 1 also comprising a cell phone pocket attached to and between the first upright and the cup receiver.

5. The chair with removable cup holder of claim 1 also comprising a projection on the bottom surface of the selected one of the pair of chair arms, the projection sized and configured to engage the base of the cup holder when the cup holder is attached to the bottom surface of the selected one of the pair of chair arms.

6. The chair with removable cup holder of claim 1 also comprising a detent on the second upright and a second projection on the bottom surface of the selected one of the pair of chair arms, the second projection sized and configured to engage the detent when the cup holder is attached to the bottom surface of the selected one of the pair of chair arms.

7. The chair with removable cup holder of claim 1 wherein the base of the U-shaped body is resting on the top surface of the selected one of the pair of chair arms.

8. The chair with removable cup holder of claim 1 wherein the post extending from the bottom surface of the selected one of the pair of chair arms is extending through the hole in the cup receiver.

9. The chair with removable cup holder of claim 1 wherein the chair and the cup holder are each molded of a plastic selected from the group consisting of polypropylene, polyvinyl chloride, polycarbonate and ABS.

10. The chair with removable cup holder of claim 9 wherein the chair and the cup holder are made of a same plastic.

11. A chair with removable cup holder comprising:

a chair having a pair of arms each arm having a top surface, a bottom surface opposite the top surface and a post on the bottom surface of a selected one of the pair of chair arms; and a cup holder comprising:

a U-shaped body having a base having a first end, a second end opposite the first end and a hole through the base, a first upright attached to the first end and a second upright attached to the second end, the first upright being spaced from the second upright such that the U-shaped body will fit onto the selected one of the pair of chair arms, the base is resting on the top surface of the selected one of the chair arms and the selected one of the pair of chair arms being between the uprights; and a cup receiver having a bottom and at least one sidewall extending from the bottom, the cup receiver attached to the first upright;

wherein the post on the bottom surface of the selected one of the pair of chair arms is sized and configured to pass through the hole in the base of the inverted U-shaped body and create a snap fit.

12. The chair with removable cup holder of claim 11 also comprising a cell phone holder attached to the second upright, the second upright forming one wall of the pocket.

13. The chair with removable cup holder of claim 12 wherein the cell phone holder and the second upright are molded as a single structure.

14. The chair with removable cup holder of claim 11 also comprising a cell phone pocket attached to and between the first upright and the cup receiver, the first upright forming one wall of the pocket.

15. The chair with removable cup holder of claim 11 also comprising a projection on the bottom surface of the selected one of the pair of chair arms, the projection sized and configured to engage the base of the cup holder when the cup holder is attached to the bottom surface of the selected one of the pair of chair arms.

16. The chair with removable cup holder of claim 11 also comprising a detent on the second upright and a second projection on the bottom surface of the selected one of the pair of chair arms, the second projection sized and configured to engage the detent when the cup holder is attached to the bottom surface of the selected one of the pair of chair arms.

17. A chair with removable cup holder comprising:

a chair having a pair of arms each arm having a top surface, a bottom surface opposite the top surface and a post on the bottom surface of a selected one of the pair of chair arms; and a cup holder comprising:

a U-shaped body having a base having a first end, a second end opposite the first end and a the base, a first upright attached to the first end and a second upright attached to the second end, the first upright being spaced from the second upright such that the U-shaped body will fit onto the selected one of the pair of chair arms, the base is positioned adjacent the bottom surface of the selected one of the chair arms; and a cup receiver having a bottom and at least one sidewall extending from the bottom, the cup receiver attached to the first upright;

wherein one of the bottom of the cup receiver and the base of the inverted U-shaped body has a hole and the post on the bottom surface of the selected one of the pair of chair arms is passing through the hole.

18. The chair with removable cup holder of claim 17 the second upright having a detent also comprising a projection on the bottom surface of the selected one of the pair of chair arms, the projection engaging the detent.

19. The chair with removable cup holder of claim 17 also comprising a cell phone holder attached to the second upright, the second upright forming one wall of the pocket.

20. The chair with removable cup holder of claim 17 also comprising a cell phone pocket attached to and between the first upright and the cup receiver, the first upright forming one wall of the pocket.

* * * * *